US011519204B2

(12) United States Patent
Couto Maquieira et al.

(10) Patent No.: US 11,519,204 B2
(45) Date of Patent: Dec. 6, 2022

(54) OPENING CONTROL WITH A LINEAR ACTUATOR FOR A MOTOR VEHICLE

(71) Applicant: AKWEL VIGO SPAIN S.L, Vigo Pontevedra (ES)

(72) Inventors: Delmiro Javier Couto Maquieira, Pontevedra (ES); Alberto Diez Estevez, Pontevedra (ES); Javier Casal Gomez, Vigo (ES); Jose Oscar Vazquez Carballo, Vigo (ES); Julio Garcia Rodriguez, Pontevedra (ES)

(73) Assignee: AKWEL VIGO SPAIN SL, Vigo Pontevedra (ES)

( * ) Notice: Subject to any disclaimer, the term of this patent is extended or adjusted under 35 U.S.C. 154(b) by 549 days.

(21) Appl. No.: 16/356,904

(22) Filed: Mar. 18, 2019

(65) Prior Publication Data

US 2019/0284850 A1 Sep. 19, 2019

(30) Foreign Application Priority Data

Mar. 16, 2018 (FR) ..... 18/70301
Dec. 20, 2018 (FR) ..... 18/73533

(51) Int. Cl.
*E05B 85/10* (2014.01)
*E05B 85/16* (2014.01)
*E05B 81/08* (2014.01)

(52) U.S. Cl.
CPC ..... *E05B 85/107* (2013.01); *E05B 85/103* (2013.01); *E05B 85/16* (2013.01); *E05B 81/08* (2013.01); *E05Y 2900/531* (2013.01)

(58) Field of Classification Search
CPC ..... E05B 85/103; E05B 85/16; E05B 81/76; E05B 81/77; E05B 81/78; E05B 81/16;
(Continued)

(56) References Cited

U.S. PATENT DOCUMENTS 3,993,338 A 11/1976 Cherbourg et al.
4,728,133 A 3/1988 Valley
(Continued)

FOREIGN PATENT DOCUMENTS

CN 105649437 A * 6/2016
DE 102004054189 A1 5/2006
(Continued)

OTHER PUBLICATIONS

Oxford English Dictionary, Definition of Bracket, 2021, Lexico.com, https://www.lexico.com/en/definition/bracket (Year: 2021).*
(Continued)

*Primary Examiner* — Kristina R Fulton
*Assistant Examiner* — Emily G. Brown
(74) *Attorney, Agent, or Firm* — Oliff PLC

(57) ABSTRACT

An opening control has a case and a handle mounted so as to tilt about an axis relative to the case between at least one rest position and an ejected position, a lever for pivoting the handle in ejection and/or retraction and electrical actuation element of the pivot lever. The lever is configured to pivot about an axis common to the handle and has a member for elastically returning into a return position in which it is adapted to retain the handle in its rest position. The actuation element is configured to make the lever pivot against the return force of the return member so as to drive in its rotational movement the handle from its rest position to its ejected position.

11 Claims, 5 Drawing Sheets

(58) Field of Classification Search
CPC ..... E05B 81/90; E05B 81/06; E05B 81/42; E05B 81/64; E05B 85/10; E05B 85/107
See application file for complete search history.

(56) References Cited

U.S. PATENT DOCUMENTS

| | | | | |
|---|---|---|---|---|
| 4,889,373 | A | 12/1989 | Ward et al. | |
| 5,685,584 | A | 11/1997 | Baren et al. | |
| 6,460,905 | B2 | 10/2002 | Suss | |
| 6,598,913 | B2 | 7/2003 | Meinke | |
| 7,552,954 | B2 | 6/2009 | Rozo et al. | |
| 7,866,714 | B2 | 1/2011 | Monig et al. | |
| 8,579,337 | B2 | 11/2013 | Hidding et al. | |
| 8,701,353 | B2 * | 4/2014 | Patel | E05B 85/103 49/503 |
| 9,605,452 | B2 * | 3/2017 | Yoshino | E05B 85/107 |
| 10,435,926 | B2 | 10/2019 | Brown et al. | |
| 10,487,547 | B2 | 11/2019 | Malvy et al. | |
| 10,563,437 | B2 * | 2/2020 | Bartels | B60Q 1/2669 |
| 10,655,371 | B2 | 5/2020 | Soonthornwinate et al. | |
| 10,794,096 | B2 | 10/2020 | Hamacher et al. | |
| 10,954,702 | B2 | 3/2021 | Couto Maquieira et al. | |
| 2016/0222705 | A1 * | 8/2016 | Velicanin | E05B 81/06 |
| 2016/0281397 | A1 * | 9/2016 | Park | E05B 81/42 |
| 2018/0274271 | A1 * | 9/2018 | Och | E05B 85/103 |
| 2019/0024422 | A1 | 1/2019 | Inan et al. | |
| 2019/0218835 | A1 | 7/2019 | Karlein et al. | |
| 2021/0156178 | A1 * | 5/2021 | Heyduck | E05B 81/42 |

FOREIGN PATENT DOCUMENTS

| | | | | |
|---|---|---|---|---|
| DE | 10 2004 058 874 | A1 | 6/2006 | |
| DE | 102012210278 | A1 | 12/2013 | |
| DE | 10 2014 117 005 | A1 | 5/2016 | |
| DE | 102015011468 | A1 | 3/2017 | |
| DE | 102016101568 | A1 | 8/2017 | |
| DE | 10 2016 113 695 | A1 | 1/2018 | |
| DE | 102016217647 | A1 * | 3/2018 | |
| EP | 3 141 679 | A1 | 3/2017 | |
| EP | 3 255 231 | A1 | 12/2017 | |
| FR | 2941994 | A1 | 8/2010 | |
| FR | 3 024 173 | A1 | 1/2016 | |
| FR | 3023865 | A1 | 1/2016 | |
| FR | 3 026 131 | A1 | 3/2016 | |
| FR | 3071861 | A1 | 4/2019 | |
| FR | 3087810 | A1 | 5/2020 | |
| GB | 2 536 672 | A | 9/2016 | |
| WO | WO-2016113339 | A1 * | 7/2016 | E05B 81/82 |
| WO | WO-2018137839 | A1 * | 8/2018 | E05B 81/90 |

OTHER PUBLICATIONS

U.S. Appl. No. 16/356,277, filed Mar. 18, 2019 in the name of Delmiro Javier Couto Maquieira et al.
U.S. Appl. No. 16/356,770, filed Mar. 18, 2019 in the name of Delmiro Javier Couto Maquieira et al.
Mar. 1, 2022 Office Action issued in U.S. Appl. No. 16/356,770.
Jan. 6, 2022 Office Action Issued In U.S. Appl. No. 16/356,277.
Jul. 18, 2022 Office Action issued in U.S. Appl. No. 16/356,277.
Sep. 16, 2022 Office Action issued in U.S. Appl. No. 16/356,770.

* cited by examiner

OPENING CONTROL WITH A LINEAR ACTUATOR FOR A MOTOR VEHICLE

BACKGROUND

The present invention relates to the technical field of opening controls for a motor vehicle. More particularly but not exclusively, the invention relates to an external opening control which comprises mechanical unlocking element.

In general, an external opening control comprises a fixed support configured to be mounted on the door leaf and a handle movably mounted on the support, for example pivotally mounted on the support by being rotatably hinged about an axis.

The opening control also comprises an unlocking mechanism, which when the handle is maneuvered in traction, enables unlocking of the latch and thus opening of the door. Conventionally, the latch comprises a bolt secured to the door adapted to cooperate with a striker secured to the door adapted to cooperate with a striker secured to the body. When opening the door from outside the vehicle, the bolt is released from the striker by actuation of the external opening control.

More particularly, the invention relates to an opening control with a «flush» type handle, that is to say that the support on which the handle is movably mounted forms a cavity adapted to receive the handle in the retracted configuration. In this retracted configuration, the external surface of the handle flushes with the external surface of the external wall of the door leaf. In the emerged or deployed configuration, the handle emerges at least partially from the cavity of the support so as to be able to be grasped by a user of the vehicle in order to open the door. For this purpose, the user can displace the handle further outwards in order to control the latch of the door.

In general, the opening control comprises an electrical ejection mechanism of the handle to enable the gripping of the handle by the user and the opening of the door leaf. The electrical ejection mechanism operates through an electrical power supply delivered for example by a battery of the motor vehicle and can be remotely and electronically controlled thanks to a key, a mobile phone or any other device enabling a remote communication.

There is already known from the prior art, in particular from the patent application EP 3 255 231 A1, a motor vehicle handle configured to cooperate with a locking mechanism and movable between a flush position, an ejected position and an opening position in which the gripping element cooperates with the locking mechanism to activate the locking mechanism and to unlock the door. In order to electrically actuate the ejection, a drive mechanism is displaced in rotation about a rotational drive axis and drives an actuator lever cooperating with the handle. The drive mechanism further comprises a clutch system in order to enable the handle to be displaced from the ejected position to the flush position.

SUMMARY

The drawback of such a drive mechanism of the handle is the necessity to resort to a clutch system in order to displace the handle from the ejected position to the flush position.

In particular, in the case where a backup mechanism is used, in case of failure of the electrical drive mechanism, it is necessary to provide unclutching element which makes the opening control complex and more expensive.

To this end, an object of the invention is an opening control for a door leaf of a motor vehicle of the type comprising:

- a case configured to be mounted on the door leaf,
- a handle mounted so as to tilt about an axis relative to the case between at least a rest position and an ejected position in which the handle is at least partially emerged from the case,
- a lever for pivoting the handle in ejection and/or retraction and electrical actuation element of the pivot lever, characterized in that the lever is configured to pivot about an axis common to the handle and comprises a member for elastically returning into a return position in which it is adapted to retain the handle in its rest position and in that the actuation element are configured to make the lever pivot against the return force of the return member so as to drive in its rotational movement the handle from its rest position to its ejected position.

Thanks to the invention, the electrical actuator cooperates with an elastically-biased ejection lever. In case of an electrical failure, the lever can remain immobile in its rest position in order to enable the movement of the handle independently of the lever and thus enable the actuation of the backup mechanism.

An opening control according to the invention may further include one or more of the following features.

In another embodiment of the invention, the lower face of the handle comprises a shoulder delimiting a transverse bearing wall from which the inner branch is extended axially and against which the lever bears so as to make the handle pivot.

In another embodiment of the invention, the lever has a bracket-like shape inside which an inner branch of the handle is engaged and comprising at least one lower connecting cross-bar adapted to cooperate with the inner branch.

In another embodiment of the invention, the bracket comprises a bracket head extending above an upper face of the handle and a bracket floor formed by the lower bar bearing against a lower face of the handle.

In another embodiment of the invention, the bracket has at the front an arch-like general shape linking the head and the floor by two arcuate lateral arms.

In another embodiment of the invention, the head and the floor are linked together preferably by two bent lateral branches at the apex of which the bracket is hinged.

In another embodiment of the invention, the lever comprises a hinge support provided with two bearings for guiding in rotation the lever about the axis A1.

In another embodiment of the invention, the electrical actuation element comprise an ejection arm extending in a direction transverse to the handle so as to bear against the lever and cause it to pivot against the return force.

In another embodiment of the invention, the ejection arm is pivotally mounted at one of its ends between two flanges of the case of the opening control.

In another embodiment of the invention, the electrical actuation element comprise a linear actuator linked to the ejection arm, the electrical actuator comprising a linear cylinder provided with an end cooperating with an end of the ejection arm to make the ejection arm pivot about a vertical axis.

In another embodiment of the invention, the handle is configured to freely pivot inside the lever when the lever is immobile, against a return spring of the handle within the limits of a predefined range of angular displacement inside the lever.

BRIEF DESCRIPTION OF THE DRAWINGS

Other features and advantages of the invention will appear in light of the following description, made with reference to the appended drawings in which.

DETAILED DESCRIPTION OF EMBODIMENTS

Figure 1:
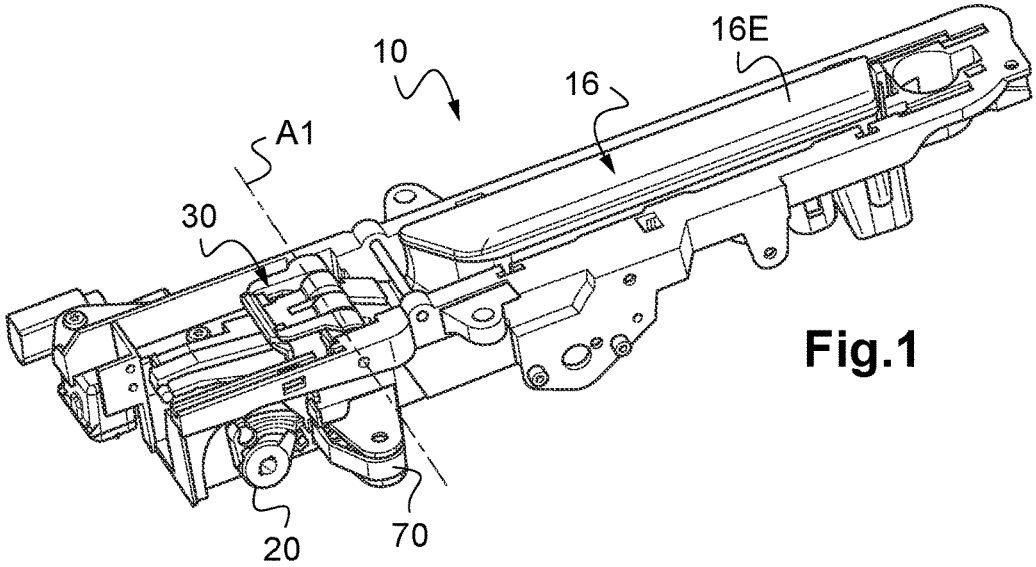
FIG. 1 is a perspective view of an opening control according to a first embodiment of the invention.
Figure 2:
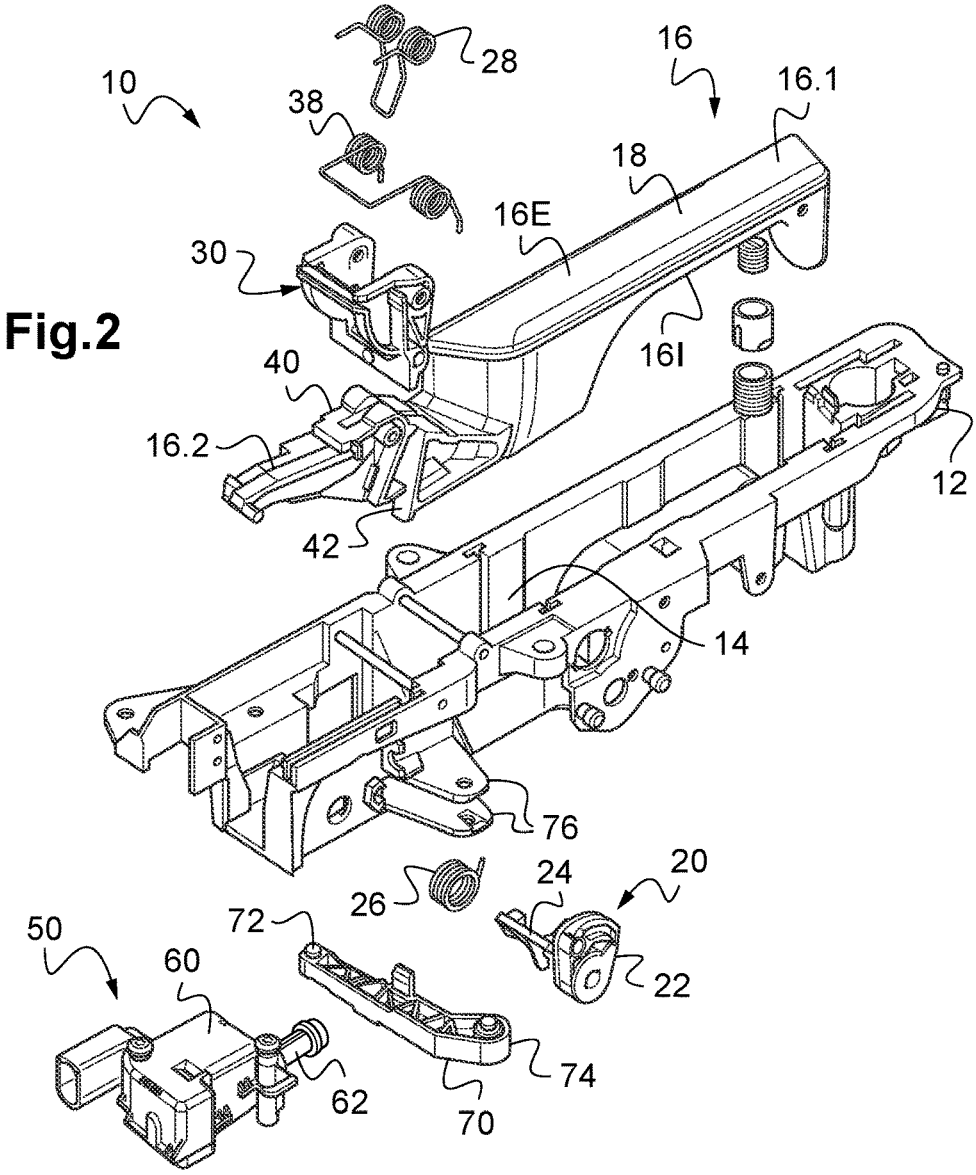
FIG. 2 is an exploded perspective view of the control of FIG. 1.

There is schematically represented in FIGS. 1 and 2 an opening control for a door leaf of a motor vehicle according to a first embodiment of the invention. The opening control is referred to by the general reference 10.

The opening control 10 is configured to be mounted on a body external panel (not represented) of a door leaf which is for example a vehicle side door.

For example, the opening control 10 mainly includes a fixed support or case 12 having a cavity 14 for receiving a handle and a handle 16 movably mounted inside the cavity 14. In service, the support 12 is configured to be fastened to the door leaf. In the described example, the handle 16 is hingedly mounted relative to the panel, about a pivot geometric axis A1, on the support 12. In service position, the pivot axis A1 is substantially vertical and extends parallel to the general plane of the external panel.

In the illustrated example, the support 12 has a parallelepiped general shape and is adapted to be housed within a cutout or a recess of the external panel of the door leaf such that its external face is flush with the surface of the external panel of the door leaf. Moreover, the support 12 is, in this example, open on the side of its external face and delimits the cavity 14 configured to house the handle 16.

The handle 16 is represented in detail in FIG. 2. In the described example, the handle 16 has an outer portion 16.1 that the user can grasp and opposite to the outer portion 16.1, the handle 16 has an inner portion 16.2 which is configured to extend inside the housing 14 of the case 12. In a conventional and non-limiting manner, on the outer portion 16.1, the handle 16 includes a gripping paddle 18, which generally has a flat and elongate shape.

In the described example, the handle 16 is of the «flush» type, which is to say that the cavity 14 of the support 12 is sized to receive the handle 16 in a retracted configuration. In this retracted configuration, the external surface 16E of the handle 16 is flush with the external surface of the external wall of the door leaf. In the emerged or deployed configuration, the handle 16 emerges at least partially from the cavity 14 of the support 12 so as to be able to be grasped by a user of the vehicle in order to open the door. For this purpose, the use can displace the handle 16 in traction further toward the outside in order to control the latch of the door. In the flush position, the external surface of the opening control 10 coincides with the external surface of the door leaf. This «flush» arrangement, known in the automotive industry, allows adding value to the style of the vehicle and reduces the aerodynamic drag.

Nonetheless, it should be understood that other movable mountings may be considered, such as in particular by pivoting about an axis located at another position or else by translation along a direction essentially perpendicular to the general plane of the door. It should also be noted that the movable mounting of the handle relative to the support is known per see to those skilled in the art.

In this example, the opening control 10 is configured to cooperate with a latch (not represented) of the door leaf of the motor vehicle capable of adopting a locked configuration and an unlocked configuration. Conventionally, pivoting of the handle 16 about its hinge axis A1 actuates the latch in either one of its two locked or unlocked configurations via a drive kinematic chain (not represented in the figures).

To this end, as illustrated in FIGS. 1 and 2, the opening control 10 preferably comprises a transmission lever 20. This transmission lever 20 comprises in the described example a rotary cage 22 and a transmission shaft 24 as well as a transmission return spring 26 configured to be housed inside the rotary cage 22. The rotary cage 22 comprises for example an element for retaining an end of a Bowden cable (not represented). This transmission set 20 is configured to be mounted on the support 12 as illustrated in FIG. 1.

In the example illustrated in FIG. 2, the opening control 10 comprises an electrical actuation portion 50 enabling an electrical actuation of the ejection and/or of the retraction of the handle 16.

We will now describe in detail the electrical actuation portion 50. For its electrical operation, as illustrated in FIG. 2, the opening control 10 preferably further comprises a pivot lever 30 for pivoting the handle 16 in ejection and/or in retraction.

As illustrated in FIG. 2, the pivot lever 30 is preferably mounted so as to tilt about the pivot axis A1 of the handle 16. Thus, in the described example, the pivot lever 30 is linked to the handle 16 by at least one common axis of rotation A1 fixed relative to the case 12.

Furthermore, preferably, the lower face 161 of the handle 16 comprises a shoulder delimiting a substantially transverse bearing wall 42 (FIG. 2) from which the inner branch 16.2 is extended axially and against which the pivot lever 30 bears so as tom make the handle 16 pivot.

Figure 3:
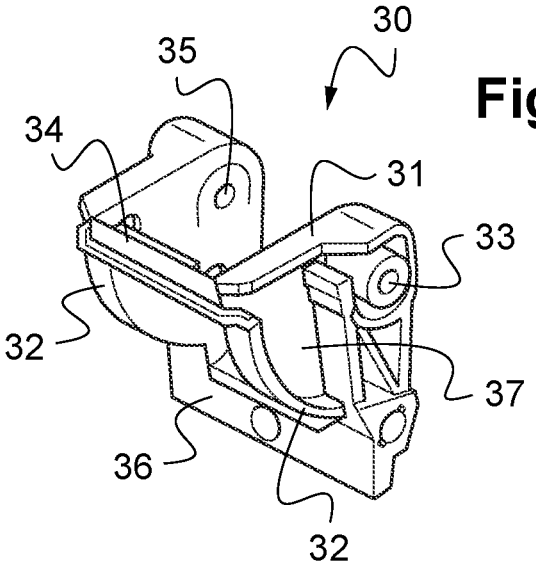
FIG. 3 is a perspective view of a handle pivot lever of the control of FIG. 2.

In FIG. 3, there is represented in detail an embodiment of a pivot lever 30. For example, this pivot lever 30 has a bracket-like general shape through which the inner portion 16.1 of the handle can be engaged (FIG. 2). Thus, in the example described and illustrated in detail in FIG. 3, the pivot lever 30 preferably comprises a body delimiting a winding inside which the inner branch 16.2 of the handle 16 can be introduced.

Preferably, the pivot lever 30 comprises a bracket head 34 extending above the handle 16. Preferably, the pivot lever 30 also includes a bracket floor 36 bearing beneath the handle, in particular against the bearing wall 42 of the handle 16. The head 34 and the floor 36 are linked together preferably by two bent lateral branches 31 at the apex 33 of which the pivot lever 30 is hinged. For example, the bent lateral branches 31 have an «L»-like general shape and the apex 33 is formed at the angle of the «L». The bracket head 34 preferably comprises an upper connecting cross-bar 34 and the bracket floor 36 is formed by a lower connecting cross-bar 36.

As shown in FIG. 2, the transverse bearing wall is slightly inclined 42. In this example, the lower bar 36 of the pivot lever 30 bears on this bearing wall 42. Furthermore, preferably, the upper bar 34 of the pivot lever 30 extends above an upper face 16E of the handle 16, at the level of the inner branch 16.2. The upper face 16E of the handle 16 further comprises in this example a relief shape 40 against which the upper bar 34 extends. The presence of the lower bar 36 of the pivot lever 30 allows creating a lever effect and, in particular, facilitating the tilting of the handle 16 up to its ejection position.

In the described example, this pivot lever 30 can pivot about an axis A1 common to the handle 16 which is secured to the case 12. To this end, in the described example, the pivot lever 30 comprises a hinge support 35, situated at the apices 33 location, provided at each side with two bearings for guiding in rotation the pivot lever 30 about the axis A1.

In this example, the pivot lever 30 generally has at the front an arch-like general shape inside which the inner branch 16.2 is introduced in a direction of introduction substantially perpendicular or slightly oblique to the plane containing the arch. The arch preferably links the head 34 and the floor by two arcuate lateral arms 32. For example, the ejection pivot lever 30 has first and second lateral solid cheeks 37 parallel to each other and perpendicular to the common axis of rotation A1.

The opening control 10 further comprises a return member 38 linked to the pivot lever 30. This return member 38 is configured to return the pivot lever 30 into a rest position corresponding to the flush configuration of the handle 16. This return member 38 preferably comprises a bracket spring provided with two external feet and a central portion. In FIG. 2, it is shown that each of the two feet of the bracket spring 38 is fastened to an internal wall of the case 12.

In the described example, the handle 16 is also provided with a handle 16 return member 28 which is placed between the pivot lever 30 and the inner portion 16.2 of the handle 16 and which have the axis A1 as a common axis.

The handle return spring 28 has two feet configured to be fastened to the pivot lever 30 and a central portion engaged with the inner portion 16.2, in particular in this example, engaged with the relief shape 40. In this example, the function of the handle return spring 28 is to compensate, by a return force, a clearance between the inner portion 16.1 and the pivot lever 30.

Preferably, the handle 16 is configured to pivot freely inside the pivot lever 30 when the pivot lever 30 is immobile against the handle 16 return spring 28 within the limits of a predefined range of angular displacement inside the pivot lever 30.

Furthermore, the electrically operation portion 50 comprises, in this example, an electrical actuator 60 linked to an ejection arm 70 configured to pivotally extend transversely inside the case 12 as shown in FIG. 1.

Figure 4:
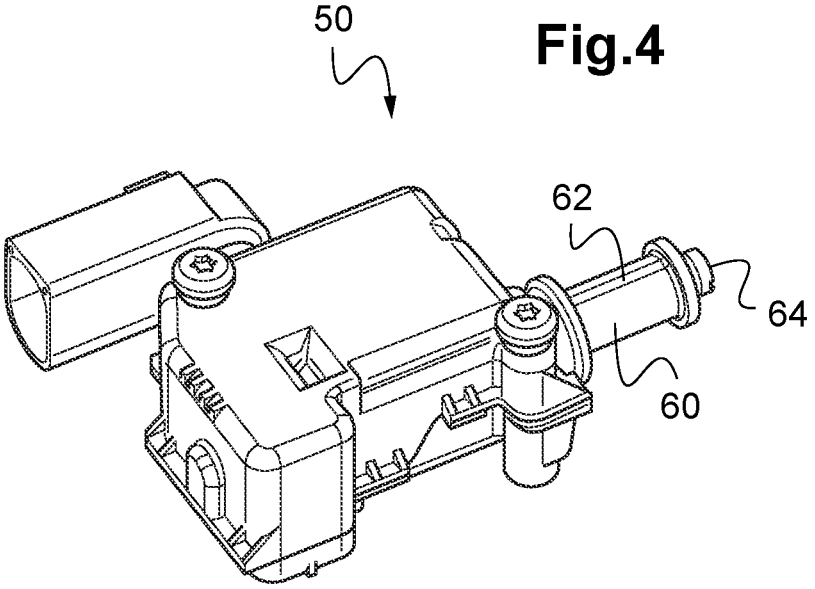
FIG. 4 is a perspective view of a linear electrical actuator of the opening control of FIG. 1.

The electrical actuator 60 is illustrated in detail in FIG. 4. As illustrated in FIG. 4, the actuator 60 preferably comprises a linear cylinder 62 provided with an end 64 cooperating with an end 72 of the ejection arm so as to make the ejection arm 70 pivot about a vertical axis. For example, the end 64 comprises a notch and the end 72 comprises a projecting lug.

In the described example, as illustrated for example in FIG. 2, the ejection arm 70 comprises an end 74 pivotally mounted between two parallel flanges 76 of the case 12.

Figure 7:
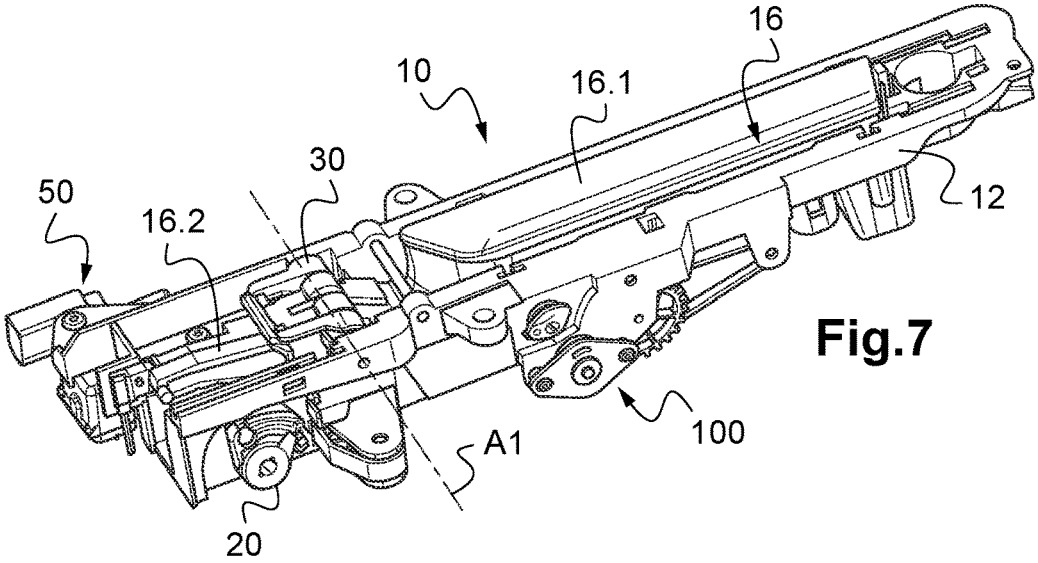
FIG. 7 is a perspective view of the opening control according to a second embodiment of the invention.
Figure 8:
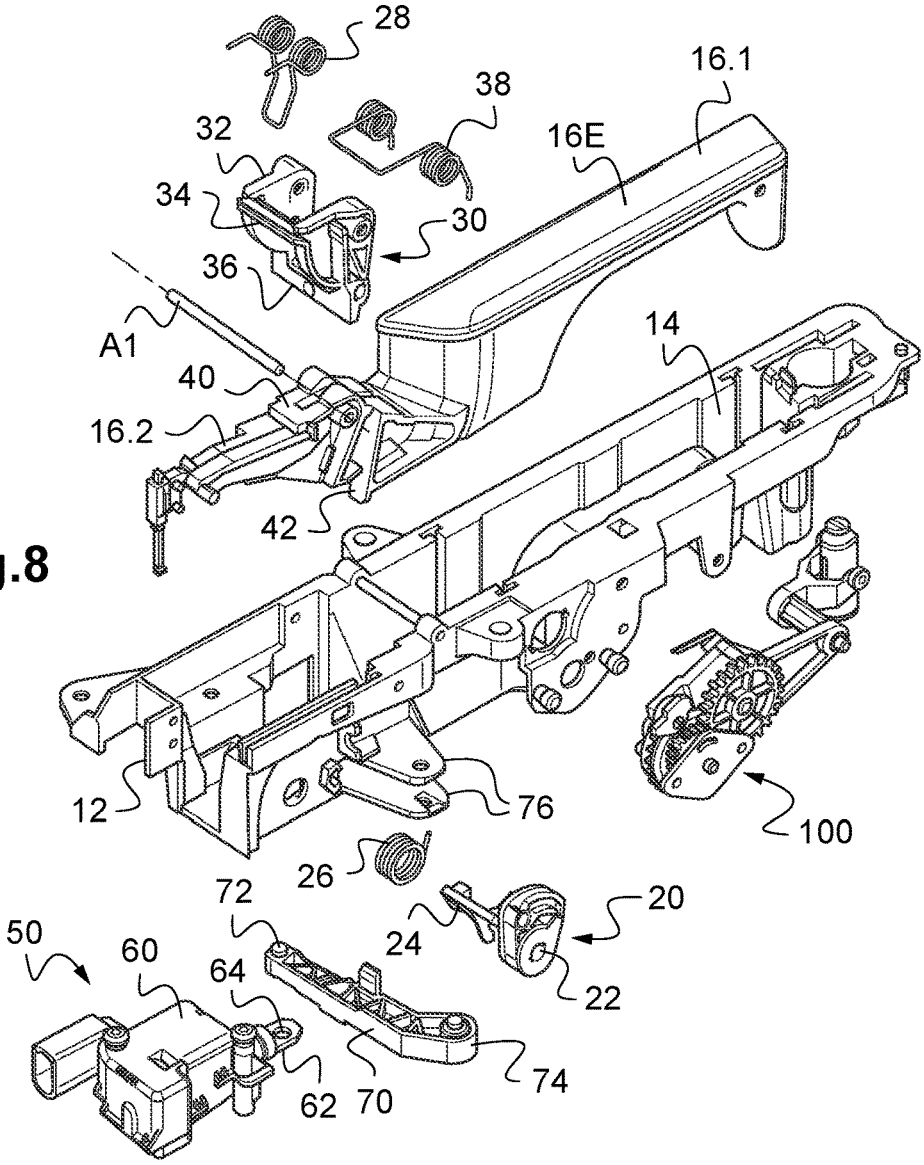
FIG. 8 is an exploded perspective view of the opening control of FIG. 7.

In a second embodiment illustrated in FIGS. 7 and 8, optionally, the opening control 10 further comprises a backup mechanical portion 100 enabling a mechanical actuation of the movement of the handle 16 in case of failure of the electrical actuation. In this second embodiment, elements similar to the first embodiment bear identical references in the figures.

In this second embodiment, the opening control 10 further comprises a mechanism 100 enabling a mechanical actuation of an ejection and retraction movement of the handle 16. In accordance with this second embodiment of the invention, in the case where the electrical operation turns out to be impossible because of an electrical failure, the opening control 10 may include in accordance with the invention a backup mechanism 100 preferably provided with an elastic energy accumulator. In order to reload the elastic energy accumulator, the handle 16 should be pushed in toward the inside of the body. This action makes the handle 16 pivot about its axis A1 in opposition to its return spring 28. In the mechanical operation, preferably, the pivot lever 30 remains immobile. Indeed, in the manual mechanical operation, the pivot lever 30 remains in its rest position because there is a clearance between the pivot lever 30 and the handle 16 enabling the movement of the handle 16 without urging the pivot lever 30.

In particular, in this second embodiment of the invention, the mechanism 100 is configured to be mechanically triggered in response to a push-in action in the case 12 of the handle 16, the completion of the push-in actioner the release being adapted to cause the triggering of the mechanism 100. Thus, the mechanism 100 comprises a kinematic chain for driving in movement the handle 16 so as to automatically drive in movement the handle 16 over all or part of a stroke starting from a pushed-in position of the handle 16 to the flush position through the ejected position. Preferably, the mechanism 100 is configured to drive in movement the handle 16 over the entire stroke.

We will now describe the main aspects of the operation of an opening control according to the first embodiment of the invention with reference to FIGS. 5A to 6B.

Figure 5A:
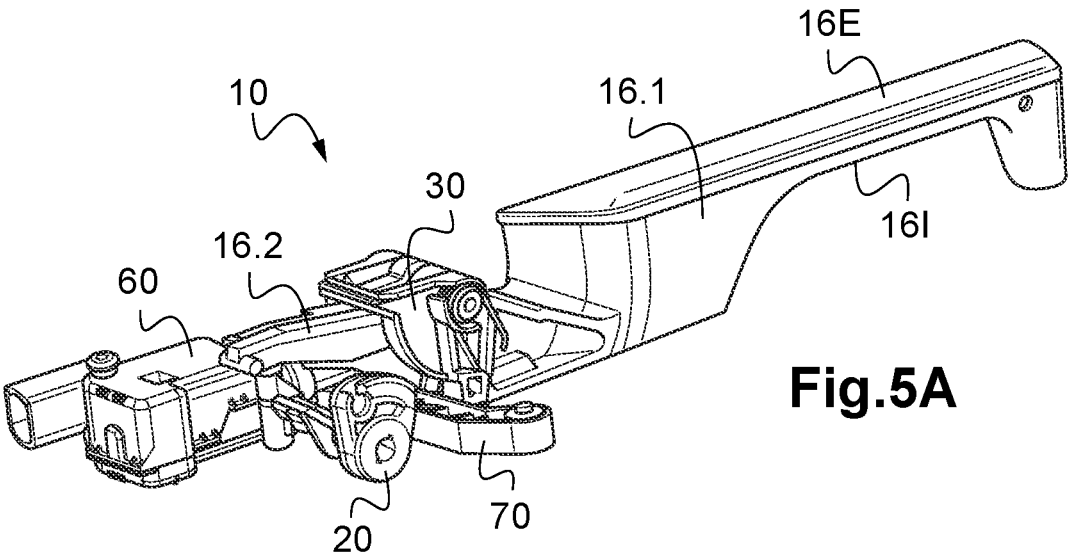
FIGS. 5A and 5B are perspective views of the handle of FIG. 1 or 2 with its electrical actuation mechanism in the rest position (FIG. 5A) and in the active position (FIG. 5B)
Figure 6A:
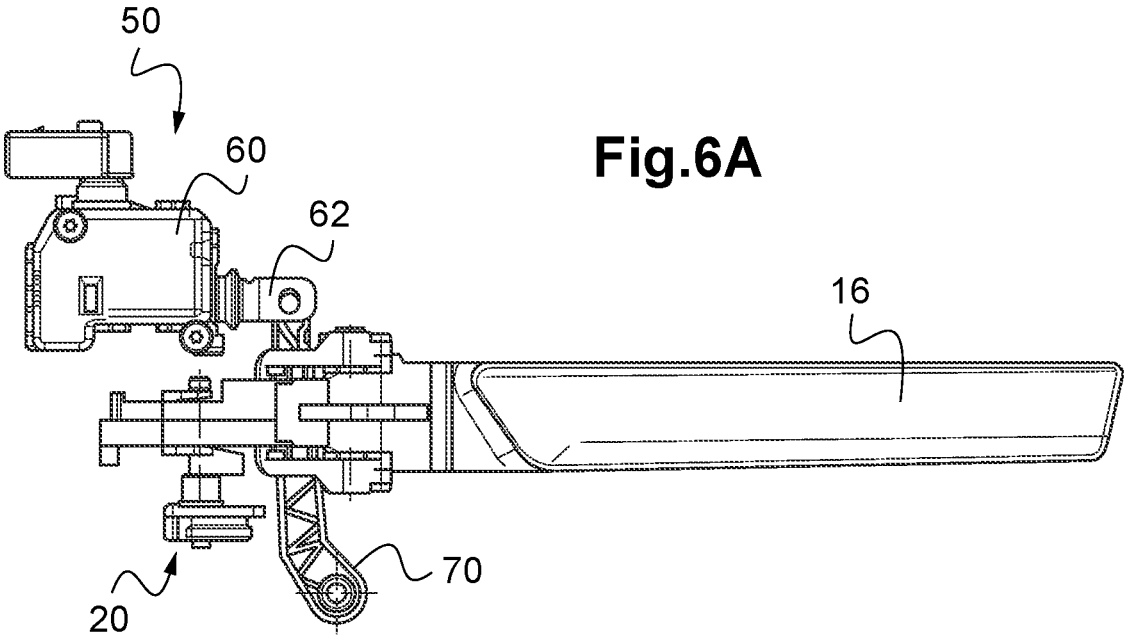
FIGS. 6A and 6B are top views of the handle of FIGS. 5A and 5B in the rest position (FIG. 6A) and in the active position (FIG. 6B)

Initially, the handle 16 is in its flush position and the pivot lever 30 is in a rest position (in FIGS. 5A and 6A).

Then, the user gives for example an opening order to an onboard computer of the motor vehicle which sends an electronic signal to the actuator 60. This order causes a displacement of a cylinder 62 of the actuator 60.

During the phase of ejecting the handle 16, the actuator 60 transmits a movement via the cylinder 62 to the ejection arm 70. The ejection arm 70 is configured to drive the pivot lever 30 against the return force of the spring 38 of the ejection lever, for example by pressing against the cross-bar 36 of the pivot lever 30.

The pivot lever 30, which has been held in the rest position by its return spring 38, is displaced until the handle 16 reaches its ejection position. In this ejection position, the user can pull the handle 16, against the spring 28 of the handle 16, and act on the transmission lever 20 so as to actuate the cable of the latch. Furthermore, preferably, the spring 28 between the handle 16 and the pivot lever 30 allows making the handle 16 return into the ejected position on completion of the action of the user by accompanying the displacement of the pivot lever 30.

Figure 5B:
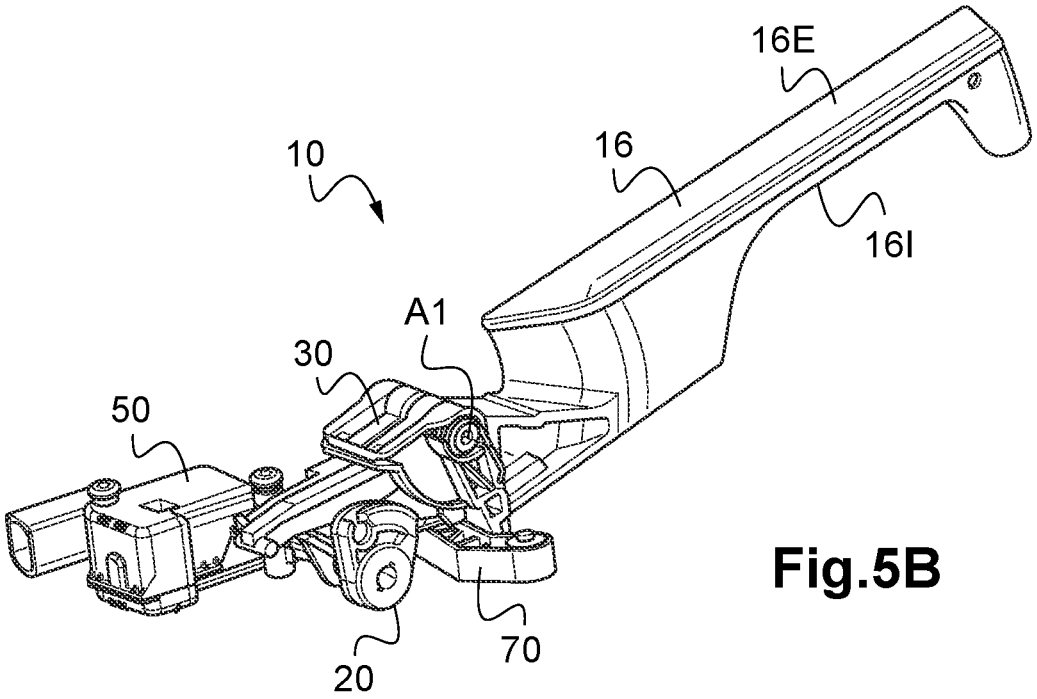
Figure 6B:
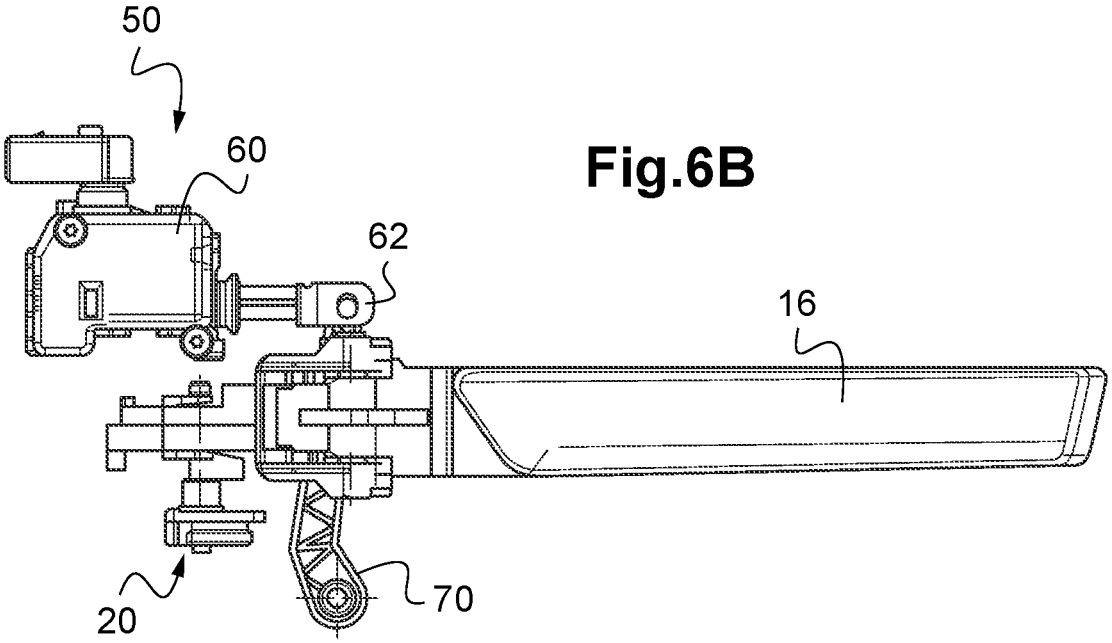

The electrical actuator then causes the pivoting of the pivot lever 30 until positioning the handle 16 in accordance with FIGS. 5B and 6B.

Finally, during the phase of retracting the handle 16, the actuator 60 is for example powered with an opposite polarity and displaces the ejection arm 70 in the reverse direction. The ejection arm 70 then preferably accompanies the movement of the pivot lever 30 whose return spring 38 tends to return into its rest position. The handle 16 accompanies the pivot lever 30 by the action of its return spring 28. In this example, the actuator 60 is bi-stable. Again, the handle 16 is in its state A.

Of course, the invention is not limited to the previously described embodiments. Other embodiments within the reach of those skilled in the art may also be considered yet without departing from the scope of the invention defined by the claims hereinafter.

The invention claimed is:

1. An opening control for a door leaf of a motor vehicle, the opening control comprising:

a case configured to be mounted on the door leaf, a handle mounted so as to tilt about an axis relative to the case between at least a rest position and an ejected position in which the handle is at least partially emerged from the case, a lever for pivoting the handle to the ejected position or the rest position, and an electrical actuation element, wherein the lever is configured to pivot relative to the handle about the axis and comprises a member for elastically returning the lever into a return position in which the member is adapted to retain the handle in the rest position and the electrical actuation element is configured to make the lever pivot against a return force of the member so as to drive, through a lever rotational movement, the handle from the rest position to the ejected position.

2. The control according to claim 1, wherein a lower face of the handle comprises a shoulder delimiting a transverse bearing wall from which an inner branch of the handle is extended axially and against which the lever bears so as to make the handle pivot.

3. The control according to claim 1, wherein the lever has a bracket-like shape inside which an inner branch of the handle is engaged and comprises at least one lower connecting cross-bar adapted to cooperate with the inner branch.

4. The control according to claim 3, wherein the lever comprises a bracket head extending above an upper face of the handle and a bracket floor formed by the lower bar bearing against a lower face of the handle.

5. The control according to claim 4, wherein the lever has two arcuate lateral arms, the two arcuate lateral arms linking the head and the floor.

6. The control according to claim 4, wherein the head and the floor are linked together by two bent lateral branches at the apex of which the bracket is hinged.

7. The control according to claim 1, wherein the lever comprises a hinge support provided with two bearings for guiding the lever in rotation about the axis.

8. The control according to claim 1, wherein the electrical actuation element comprises an ejection arm extending in a direction transverse to the handle so as to bear against the lever and cause it to pivot against the return force.

9. The control according to claim 8, wherein the ejection arm is pivotally mounted at one of its ends between two flanges of the case.

10. The control according to claim 9, wherein the electrical actuation element comprises a linear actuator linked to the ejection arm, the linear actuator comprising a linear cylinder provided with an end cooperating with an end of the ejection arm to make the ejection arm pivot about a vertical axis.

11. The control according to claim 1, wherein the handle is configured to freely pivot inside the lever and against a return spring when the lever is immobile, within a predefined range of angular displacement inside the lever.

* * * * *